US007546706B2

(12) United States Patent
Kirkwood

(10) Patent No.: US 7,546,706 B2
(45) Date of Patent: Jun. 16, 2009

(54) MODULAR SYSTEM FOR CONSTRUCTING PLATFORM AND SHELVING STRUCTURES

(76) Inventor: David Kirkwood, 1108 S. Akard #14, Dallas, TX (US) 75215

( * ) Notice: Subject to any disclaimer, the term of this patent is extended or adjusted under 35 U.S.C. 154(b) by 352 days.

(21) Appl. No.: 11/233,336

(22) Filed: Sep. 22, 2005

(65) Prior Publication Data

US 2007/0062128 A1 Mar. 22, 2007

(51) Int. Cl.
*E04B 1/346* (2006.01)
*E04B 7/16* (2006.01)
*E04B 1/00* (2006.01)

(52) U.S. Cl. ..... 52/69; 52/79.1; 52/79.5; 52/79.9; 52/66; 52/68; 52/70

(58) Field of Classification Search ..... 52/68, 52/69, 70, 79.1, 79.5, 79.9, 66; 211/134, 211/186, 189, 195, 175, 183; 312/257.1, 312/107, 108, 111; 296/173, 163
See application file for complete search history.

(56) References Cited

U.S. PATENT DOCUMENTS 649,352 A * 5/1900 Rector ..... 52/93.1
2,259,783 A * 10/1941 Sparling ..... 52/69
2,550,088 A * 4/1951 Sayer ..... 220/6
2,765,499 A * 10/1956 Couse ..... 52/66
3,356,403 A * 12/1967 Sak et al. ..... 52/580
3,792,557 A * 2/1974 Pitts ..... 52/65
4,071,286 A * 1/1978 Moyer ..... 312/348.3
4,147,198 A * 4/1979 Ytter ..... 160/135
4,166,343 A * 9/1979 O'Brian et al. ..... 52/66
4,635,411 A * 1/1987 Kurzen ..... 52/71
4,696,132 A * 9/1987 LeBlanc ..... 52/69
4,742,653 A * 5/1988 Napier et al. ..... 52/66
4,779,514 A * 10/1988 Prigmore et al. ..... 52/79.5
4,867,513 A * 9/1989 Choi ..... 312/258
4,883,443 A * 11/1989 Chase ..... 446/478
5,031,448 A * 7/1991 Saito ..... 73/61.56
5,121,877 A * 6/1992 Bodary et al. ..... 229/120
5,345,730 A * 9/1994 Jurgensen ..... 52/64
5,493,818 A * 2/1996 Wilson ..... 52/71
5,765,316 A * 6/1998 Kavarsky ..... 52/67
5,852,904 A * 12/1998 Yu et al. ..... 52/220.7
6,244,502 B1 * 6/2001 Hollar et al. ..... 229/120.011
6,601,929 B2 * 8/2003 Marihugh ..... 312/108
6,854,599 B2 * 2/2005 Ferrara et al. ..... 206/438
6,872,413 B2 * 3/2005 Rosenblum ..... 426/324
6,968,653 B2 * 11/2005 Stapleton et al. ..... 52/79.1
7,055,287 B2 * 6/2006 Yu et al. ..... 52/220.7

* cited by examiner

*Primary Examiner*—Richard E Chilcot, Jr.
*Assistant Examiner*—Mark R Wendell
(74) *Attorney, Agent, or Firm*—Roger S. Burleigh

(57) ABSTRACT

Modular system for constructing platform and shelving structures. Each module is configurable in either a stowable or assembled configuration. In the assembled configuration, a module has a central vertical member hingedly-coupled to a second vertical member extending perpendicular to a first side of the central member, and a horizontal member hingedly-coupled to the central member and extending perpendicular to a second side of the central vertical member. The upper edges of the central vertical member and the second vertical member of a first module provide support to a horizontal member of a second module, whereby various structures can be formed from a plurality of modules. Each module is easily stowable by rotating the second vertical member and the horizontal member about their hinged edges toward the central vertical member until they are substantially parallel and adjacent thereto, whereby a plurality of modules in the stowable configuration can be stored in substantially the minimum possible space.

15 Claims, 11 Drawing Sheets

A MODULE

B MODULE

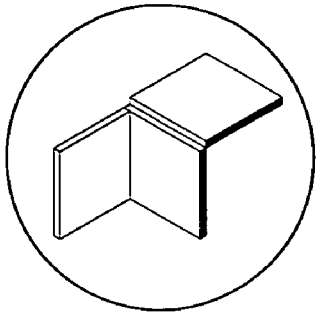
FIG. 4A
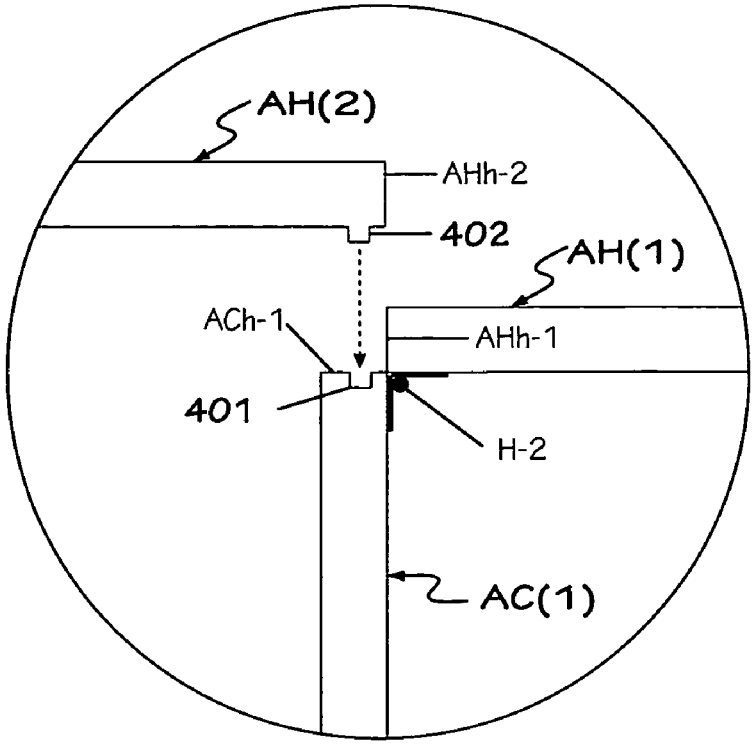
PROFILE VIEW
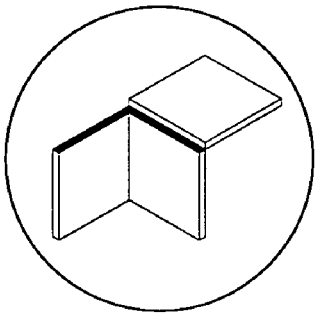
FIG. 4B
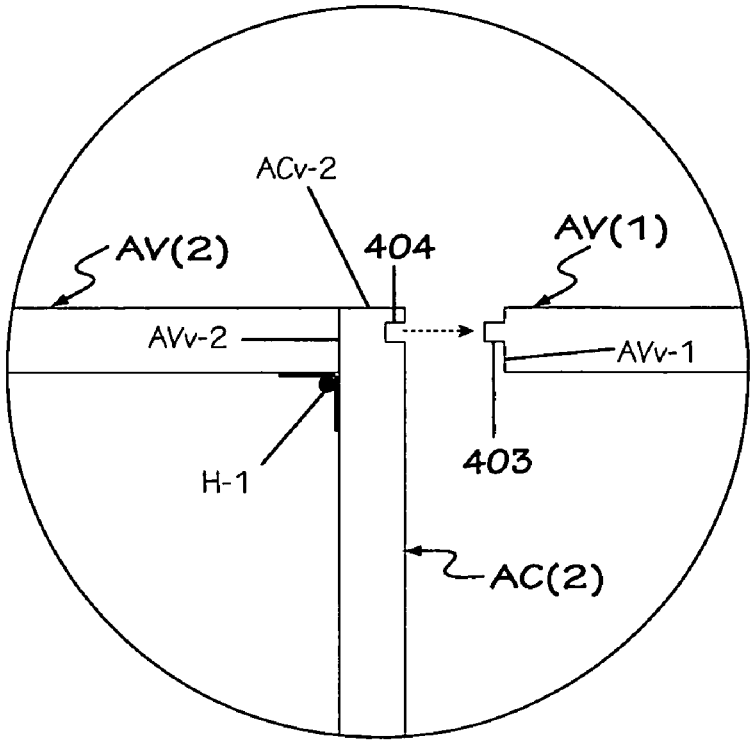
OVERHEAD VIEW

MODULAR SYSTEM FOR CONSTRUCTING PLATFORM AND SHELVING STRUCTURES

TECHNICAL FIELD OF THE INVENTION

The present invention is directed, in general, to collapsible structures and, more specifically, to collapsible platform and shelving structures.

BACKGROUND OF THE INVENTION

Portable stages, or platforms, are often used. in schools, hotels, conversion centers, and other institutions wherein multiple use facilities require the capability of setting up a temporary stage. Such stages are generally made up of a number of individual sections which are positioned adjacent each other to make an extended stage surface of whatever size is required. When not in. use, the individual sections may be folded to compact dimensions, then set aside for storage. Similarly, collapsible shelving which is easily and quickly assembled and disassembled is often used at trade shows, street vending, temporary retail displays and numerous other situations.

There are many prior art collapsible platform and shelving structures, but they are often designed to be used in only one or a few configurations. Structures designed for portable platforms are not readily used for collapsible shelving, and vice versa. Furthermore, such prior art structures often include complex supporting members that prevent the structure from being stored in a compact form. Accordingly, what is needed in the art is a new and improved system for constructing platform and shelving structures. Preferably, the system should be modular, and should allow for both platform and shelving structures to be constructed from similar modules. Furthermore, the system modules should be stowable in substantially the minimum possible space.

SUMMARY OF THE INVENTION

To address the above-discussed deficiencies of the prior art, the present invention provides a modular system for constructing platform and shelving structures. Each module is configurable in either a stowable or assembled configuration. In the assembled configuration, a module has a central vertical member hingedly-coupled to a second vertical member extending perpendicular to a first side of the central member, and a horizontal member hingedly-coupled to the central member and extending perpendicular to a second side of the central vertical member. The upper edges of the central vertical member and the second vertical member of a first module provide support to a horizontal member of a second module, whereby various structures can be formed from a plurality of modules. Each module is easily stowable by rotating the second vertical member and the horizontal member about their hinged edges toward the central vertical member until they are substantially parallel and adjacent thereto, whereby a plurality of modules in the stowable configuration can be stored in substantially the minimum possible space.

In an exemplary embodiment, a module in the assembled configuration includes: a central vertical rectangular panel having parallel top and bottom horizontal edges and parallel first and second vertical edges; a second vertical rectangular panel having parallel top and bottom horizontal edges and parallel first and second vertical edges; a first hinge member coupling the second vertical edge of the second vertical rectangular panel proximate to one of the first or second vertical edges of the central vertical rectangular panel, wherein the second vertical rectangular panel extends substantially perpendicular to a first side of the central vertical rectangular panel, and wherein the top horizontal edge of the second vertical rectangular panel is substantially within the same plane as the top horizontal edge of the central vertical rectangular panel; a horizontal rectangular panel having parallel first and second horizontal edges and parallel third and fourth horizontal edges perpendicular to the first and second horizontal edges; and, a second hinge member coupling the first horizontal edge of the horizontal rectangular panel proximate to the top horizontal edge of the central vertical rectangular panel, wherein the horizontal rectangular panel extends substantially perpendicular to a second side of the central vertical rectangular panel, and wherein a top surface of the horizontal rectangular panel is substantially parallel to the plane containing the top horizontal edges of the central and second vertical panels.

In one embodiment, the modules are "A" or "B" modules wherein, for each "A" module, the first hinge member couples the second vertical edge of the second vertical rectangular panel proximate to the first vertical edge of the central vertical rectangular panel; and, for each "B" module, the first hinge member couples the second vertical edge of the second vertical rectangular panel proximate to the second vertical edge of the central vertical rectangular panel.

In certain embodiments, at least a portion of the bottom surface of the horizontal rectangular panel and the top horizontal edge of the central vertical rectangular panel or the second vertical rectangular panel include tongue and groove portions, wherein the tongue portion associated with the horizontal rectangular panel or the central or second vertical rectangular panels of a first module is insertable into the groove portion associated with one of the horizontal rectangular panel or the central or second vertical rectangular panels of a second module. In a related embodiment, at least a portion proximate the first vertical edge of the second vertical rectangular panel and at least a portion proximate one of the parallel first and second vertical edges of the central vertical rectangular panel include tongue and groove portions, wherein the tongue portion associated with the second vertical rectangular panel or the central vertical rectangular panel of a first module is insertable into the groove portion associated with the second vertical rectangular panel or the central vertical rectangular panel of a second module.

Modules in accordance with the principles of the invention can be assembled into a wide variety of platform and shelving structures. In the simplest embodiments, a plurality of "A" or "B" modules are coupled in series, wherein the central vertical rectangular panels of each of the plurality of modules are parallel to each other. In another configuration, a plurality of "A" or "B" modules are coupled orthogonally, wherein the central vertical rectangular panels of adjacent ones of each of the plurality of modules are perpendicular to each other. A corner in a platform structure or a zig-zag series of modules can be formed from an "A" module coupled orthogonally to a "B" module, wherein the central vertical rectangular panels of adjacent modules are perpendicular to each other.

For platform structures, or the base layer of a shelving structure, modules are coupled within a single plane, wherein at least one edge of each horizontal rectangular panel of each of the plurality of modules abuts an edge of a horizontal rectangular panel of an adjacent module, whereby the horizontal rectangular panels of the plurality of modules define an elevated platform. For shelving structures, a first group of modules are coupled within a first horizontal plane and a second group of modules are coupled within a second horizontal plane, the second group being supported by the first group, wherein openings between adjacent ones of the vertical rectangular panels and the horizontal panels define a plurality of shelves in the vertical structure.

The foregoing has outlined, rather broadly, the principles of the present invention so that those skilled in the art may better understand the detailed description of the exemplary embodiments that follow. Those skilled in the art should appreciate that they can readily use the disclosed conception and exemplary embodiments as a basis for designing or modifying other structures and methods for carrying out the same purposes of the present invention. Those skilled in the art should also realize that such equivalent constructions do not depart from the spirit and scope of the invention in its broadest form.

BRIEF DESCRIPTION OF THE DRAWINGS

For a more complete understanding of the invention, reference is now made to the following detailed description taken in conjunction with the accompanying drawings, in which:

FIG. 2-B illustrates an overhead view of two panels of an exemplary module in an assembled configuration;

FIG. 2-C illustrates a profile view of an exemplary module in a stowable configuration;

FIG. 4-A illustrates a profile view of joint members for joining two panels of adjacent modules;

FIG. 4-B illustrates an overhead view of joint members for joining two panels of adjacent modules;

FIG. 5-B illustrates a second exemplary platform structure constructed using modules in accordance with the principles of the invention;

FIG. 5-C illustrates a first exemplary shelving structure constructed using modules in accordance with the principles of the invention;

FIG. 6-B illustrates a second exemplary shelving structure constructed using modules in accordance with the principles of the invention;

DETAILED DESCRIPTION

Figure 1:
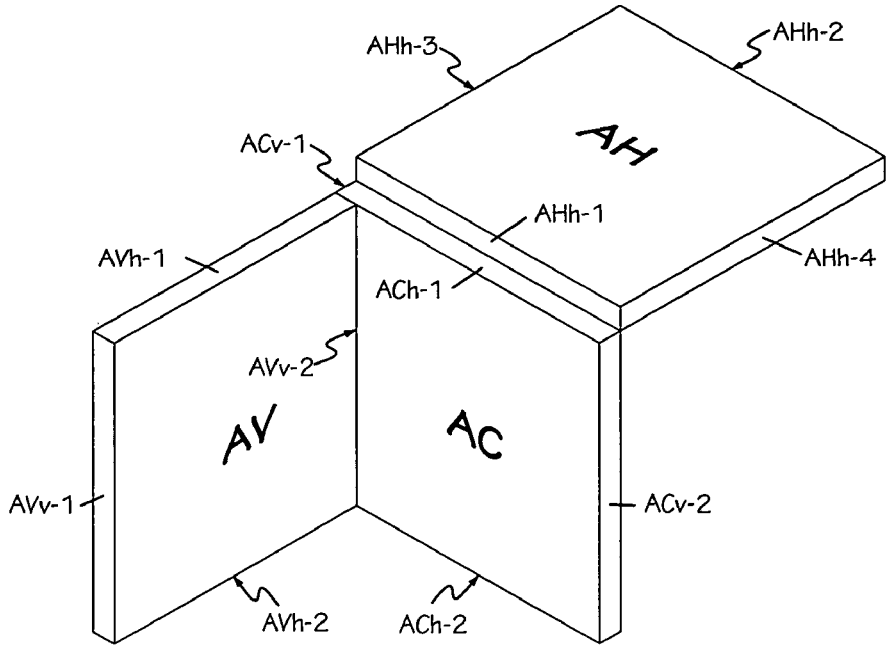
FIG. 1 illustrates first exemplary modules, in accordance with the principles of the invention, in an assembled configuration.
Figure 1:
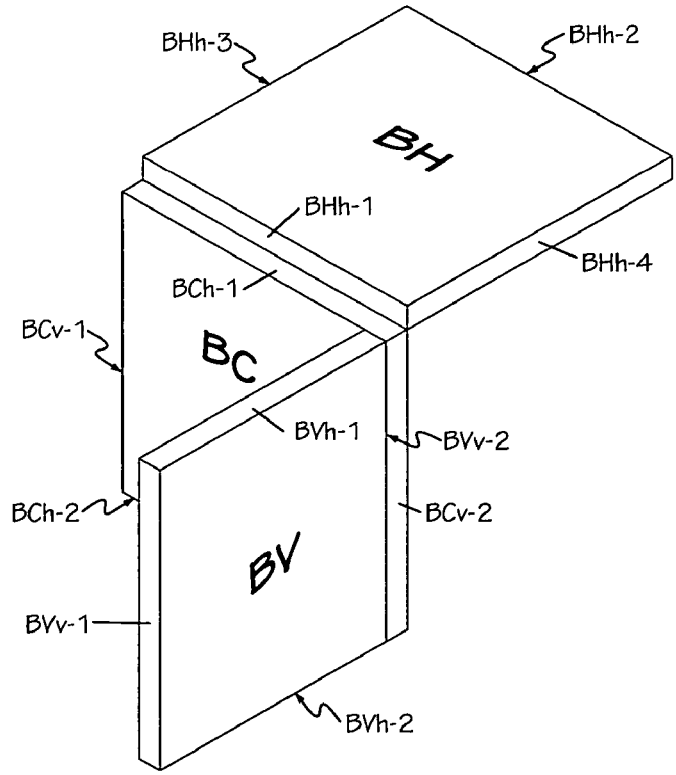
Figure 2A:
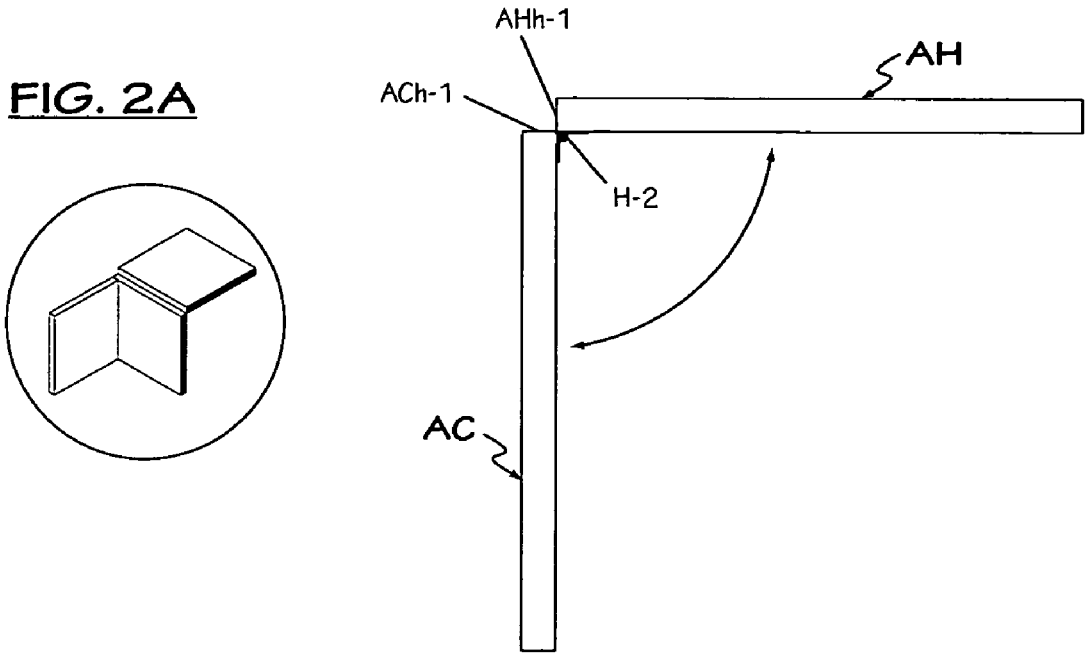
FIG. 2-A illustrates a profile view of two panels of an exemplary module in an assembled configuration.
Figure 2A:
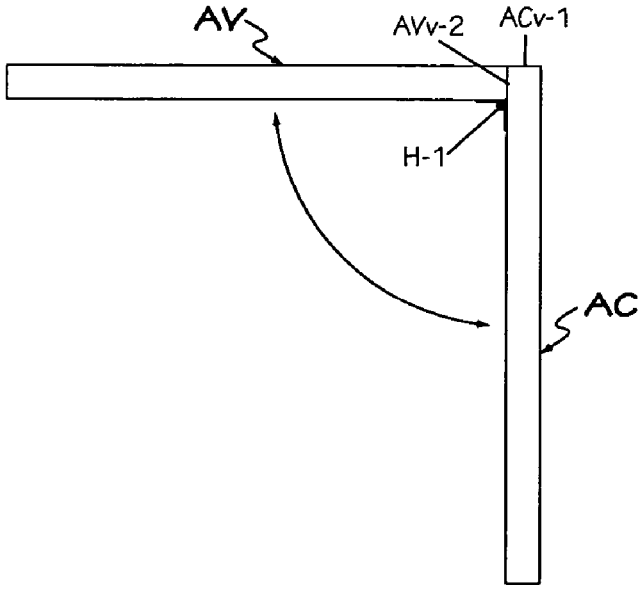
Figure 2B:
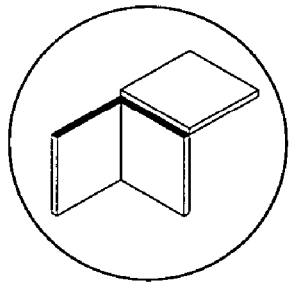
Figure 2C:
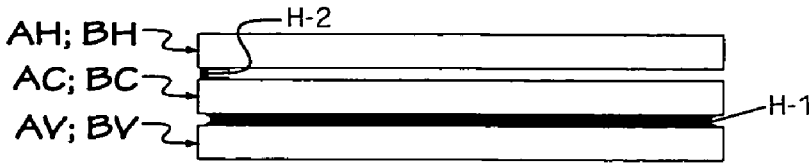

Referring to FIG. 1, illustrated are exemplary "A" and "B" modules for constructing platform and shelving structures; the modules are illustrated in an assembled configuration. In the following description, references in parentheses preceeding a semicolon refer specifically to "A" modules, and references in parentheses following a semicolon refer specifically to "B" modules. In general, each module has a central vertical member (AC; BC) hingedly-coupled to a second vertical member (AV; BV) extending perpendicular to a first side of the central vertical member, and a horizontal member (AH; BH) hingedly-coupled to the central vertical member and extending perpendicular to a second side of the central vertical member. As illustrated and described hereinafter with respect to FIGS. 4-7, the upper edges of the central vertical member and the second vertical member of a first module provide support to a horizontal member of a second module, whereby various structures can be formed from a plurality of modules. Each module is easily stowable by rotating the second vertical member and the horizontal member about their hinged edges toward the central vertical member until they are substantially parallel and adjacent thereto, whereby a plurality of modules in the stowable configuration can be stored in substantially the minimum possible space.

In the exemplary embodiment illustrated in FIG. 1, each module in the assembled configuration includes a central vertical rectangular panel (AC; BC) having parallel top and bottom horizontal edges (ACh-1, ACh-2; BCh-1, BCh-2) and parallel first and second vertical edges (ACv-1, ACv-2; BCv-1, BCv-2). A second vertical rectangular panel (AV; BV), having parallel top and bottom horizontal edges (AVh-1, AVh-2; BVh-1, BVh-2) and parallel first and second vertical edges (AVv-1, AVv-2; BVv-1, BVv-2), is coupled by a first hinge member (not shown; see FIG. 2-B) to the central vertical rectangular panel. For "A" modules, the second vertical edge (AVv-2) of the second vertical rectangular panel (AV) is coupled proximate to the first vertical edge (ACv-1) of the central vertical rectangular panel (AC); for "B" modules, the second vertical edge (BVv-2) of the second vertical rectangular panel (BV) is coupled proximate to the second vertical edge (BCv-2) of the central vertical rectangular panel (BC). In the assembled configuration, the second vertical rectangular panel (AV; BV) extends substantially perpendicular to a first side of the central vertical rectangular panel (AC; BC), and the top horizontal edge (AVh-1; BVh-1) of the second vertical rectangular panel (AV; BV) is substantially within the same plane as the top horizontal edge (ACh-1; BCh-1) of the central vertical rectangular panel (AC; BC). Finally, each "A" and "B" module includes a horizontal rectangular panel (AH; BH) having parallel first and second horizontal edges (AHh-1, AHh-2; BHh-1, BHh-2) and parallel third and fourth horizontal edges (AHh-3, AHh-4; BHh-3, BHh-4) perpendicular to the first and second horizontal edges. A second hinge member (not shown; see FIG. 2-A) couples the first horizontal edge (AHh-1; BHh-1) of the horizontal rectangular panel (AH; BH) proximate to the top horizontal edge (ACh-1; BCh-1) of the central vertical rectangular panel (AC; BC). In the assembled configuration, the horizontal rectangular panel (AH; BH) extends substantially perpendicular to a second side of the central vertical rectangular panel (AC; BC); a top surface of the horizontal rectangular panel (AH; BH) is substantially parallel to the plane containing the top horizontal edges (ACh-1, AVh-1; BCh-1, BVh-1) of the central and second vertical panels. As illustrated and described hereinafter with respect to FIGS. 4-7, the upper edges (ACh-1, AVh-1; BCh-1, BVh-1) of the central vertical member (AC; BC) and the second vertical member (AV; BV) of a first "A" or "B" module can provide support to a horizontal panel (AH; BH) of a second "A" or "B" module, whereby various platform and shelving structures can be formed from a plurality of modules.

Turning now, to FIG. 2-A, illustrated is a profile view of central vertical panel AC and horizontal rectangular panel AH of exemplary "A" module in the assembled configuration (a similar profile view is applicable to panels BC and BH of exemplary "B" module). In this embodiment, hinge member H2 couples a bottom face of horizontal rectangular panel AH, proximate to edge AHh-1, in the same plane as top horizontal edge ACh-1 of central vertical panel AC. Similarly, FIG. 2-B illustrates an overhead view of panels AC and AV of exemplary "A" module in an assembled configuration (a similar profile view is applicable to panels BC and BV of exemplary "B" module). In this embodiment, hinge member H-1 couples second vertical rectangular panel AV to central vertical panel AC such that its outer face lies in the same plane as the vertical edge ACv-1 of central vertical panel AC (or vertical edge BCv-2 of central vertical panel BC for "B" modules).

As illustrated by the arrows in FIGS. 2-A and 2-B, the horizontal rectangular panels (AH; BH) and second vertical rectangular panels (AV; BV) of each "A" or "B" module can be rotated about hinges H1 and H2 toward the central vertical rectangular panel (AC; BC) until they are substantially parallel and adjacent thereto, as illustrated in FIG. 2-C. As can be seen in FIG. 2-C, the three panels of each module are folded into the most compact area, whereby a plurality of modules in the stowable configuration can be stored in substantially the minimum possible space. Although not illustrated in FIG. 2-C, those skilled in the art will recognize that spacing elements can be included on one or more of the faces of each panel opposite to the hinged edges to compensate for the thickness of hinges H-1 and H-2, whereby the panels will be parallel in the stowable configuration, thus ensuring that a stack of stored modules will be stable. Hinge members H-1 and H-2 can be, for example, continuous, or "piano," hinges. In alternate embodiments, several hinges can be used at either end of the panels, or other flexible materials having suitable strength and flexibility can be used to couple the panels in a manner that allows them to be configured in the assembled or stowable configuration.

Figure 3:
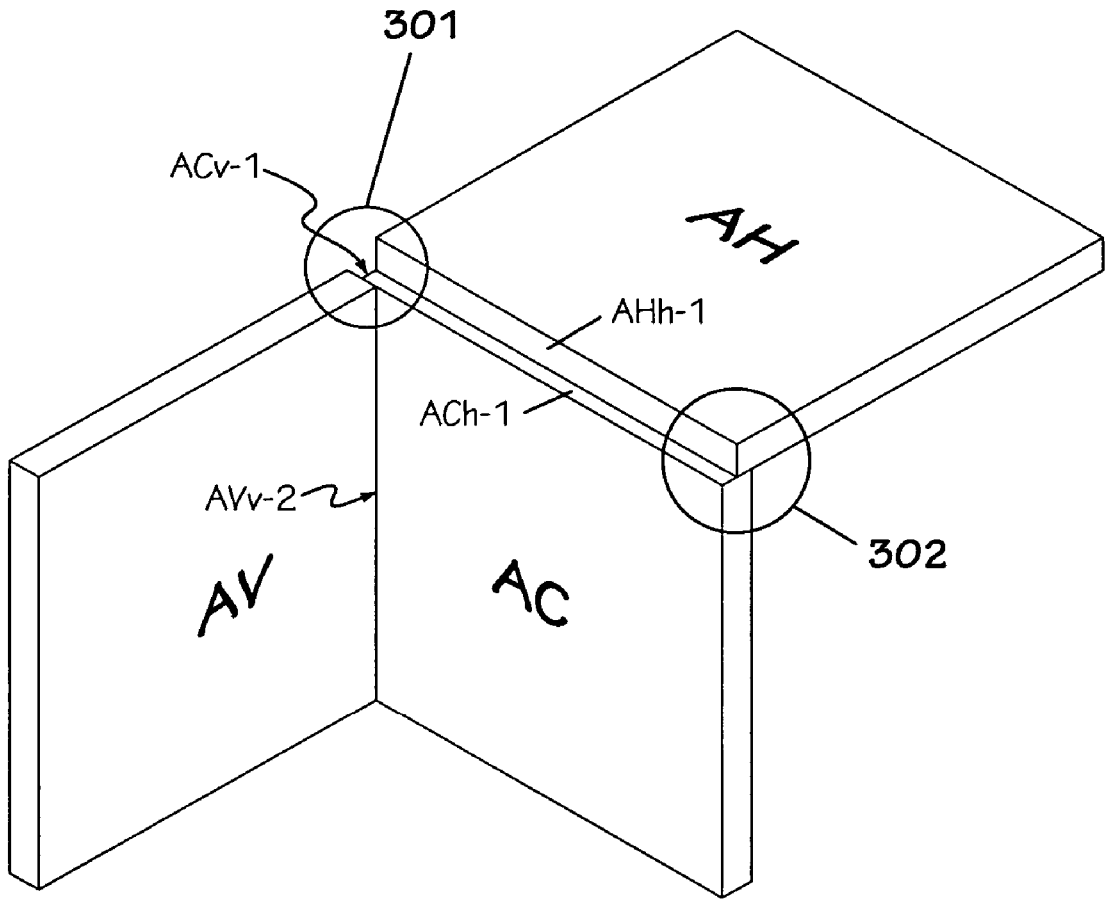
FIG. 3 illustrates a second exemplary module, in accordance with the principles of the invention, in an assembled configuration.

Turning now to FIG. 3, illustrated is a second exemplary "A" module in an assembled configuration (a similar view is applicable to "B" modules). As highlighted by viewpoints 301 and 302, it can be seen that the second vertical rectangular panel AV and horizontal rectangular panel AH are offset from the central vertical rectangular panel AC. In this embodiment, in contrast to the embodiment illustrated in FIG. 2-A, edge AHh-1 of horizontal rectangular panel AH does not lie in the same plane as the face of central vertical panel AC to which it is hingedly-coupled; rather, edge AHh-1 is offset therefrom and lies over edge ACh-1 of central vertical panel AC. Similarly, in contrast to the embodiment illustrated in FIG. 2-B, the outer face of second vertical rectangular panel AV does not lie in the same plane as edge ACv-1 of central vertical panel AC to which it is hingedly-coupled. Those skilled in the art will recognize that such variations in the relative positions at which the panels are hingedly-coupled can be utilized to advantage for modules designed specifically for certain structures. Similarly, it will be recognized that although the exemplary embodiment illustrated is constructed from substantially solid square panels of identical relative dimensions, one or more of the panels can, if desired, be non-solid and have other shapes. For example, panels AC and AV can be metal frames, while panel AH is a solid wood plank. Such alternative constructions can provide access within or through a structure for routing electrical cables.

Turning now to FIGS. 4-A and 4-B, illustrated are a profile view and overhead view of optional joint members for joining two panels of adjacent modules. In the exemplary embodiments illustrated, at least a portion of a panel of a first module, and a portion of a panel of a second module, include tongue and groove members, wherein a tongue member associated with the horizontal rectangular panel or the central or second vertical rectangular panels of one module is insertable into a groove member associated with the horizontal rectangular panel or the central or second vertical rectangular panels of another module. For example, as shown in FIG. 4-A, a tongue 402 disposed on the bottom face of horizontal panel AH(2) proximate to edge AHh-2 can be inserted in a groove 401 disposed within edge ACh-1 of central vertical panel AC(1). Similarly, as shown in the overhead view in FIG. 4-B, a tongue 403 disposed on edge AVv-1 of a second vertical panel AV(1) of a first "A" module can be inserted in a groove 404 disposed proximate edge ACv-2 on the face of central vertical panel AC(2) of a second "A" module. Although sample modules without such tongue and groove elements have been used satisfactorily to construct elevated platforms, those skilled in the art will recognize the advantage of using integral means to secure adjacent modules in certain applications. In addition, or as an alternative, other means can be used to securely couple adjacent modules, such as Velcro® tabs or snap fittings.

Figure 5A:
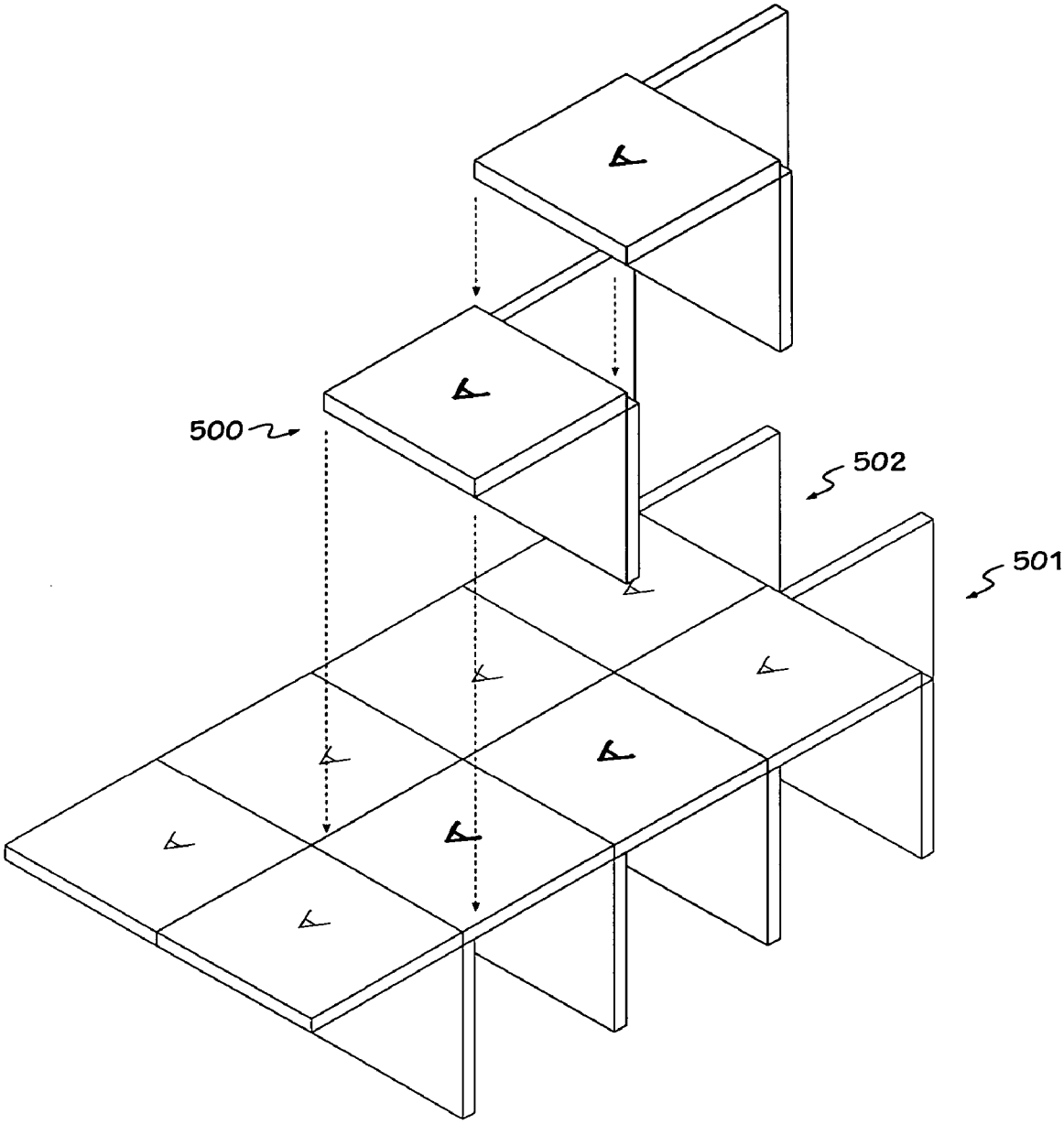
FIG. 5-A illustrates a first exemplary platform structure constructed using modules in accordance with the principles of the invention.
Figure 5B:
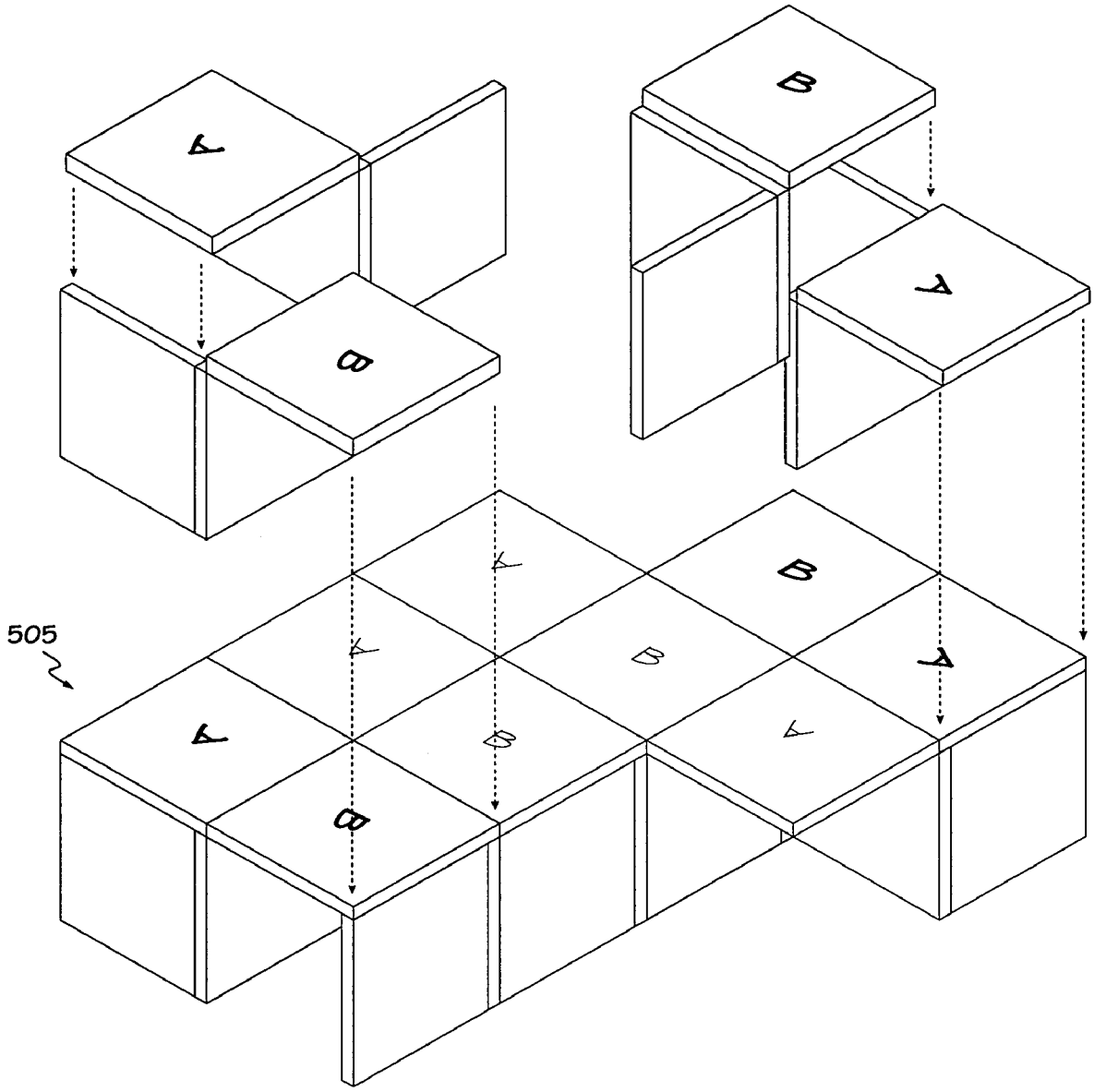
Figure 5C:
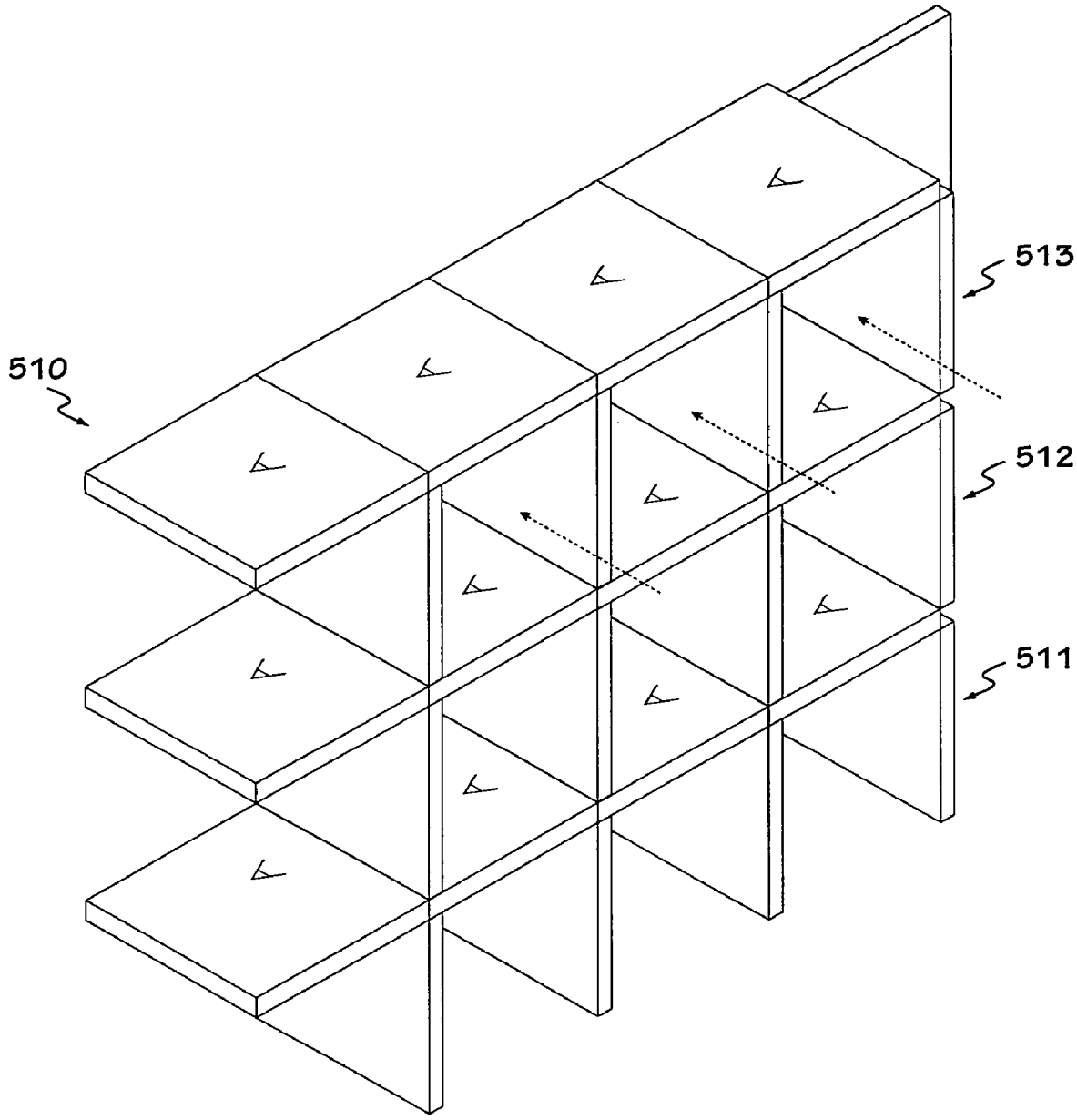

Having described the essential and optional features of exemplary "A" and "B" modules, various exemplary platform and shelving structures will now be described. Referring to FIG. 5-A, illustrated is a first exemplary platform structure 500 constructed using "A" modules in accordance with the principles of the invention (a similar structure can be constructed from "B" modules). As can be seen, platform structure 500 is constructed from two rows 501, 502 of "A" modules coupled in series, wherein the central vertical rectangular panels of each module in a row are parallel to each other. The horizontal rectangular panel of each module is supported by the top horizontal edges of the central and second vertical panels of an adjacent module—except for a module at one end of each row (the horizontal panel for such end module can be left folded against the central vertical panel). For the platform structure 500, all modules are coupled within a single plane, wherein at least one edge of each horizontal rectangular panel of each module abuts an edge of a horizontal rectangular panel of an adjacent module, whereby the horizontal rectangular panels of all modules define an elevated platform. FIG.5-B illustrates a similar platform structure 505 constructed using both "A" and "B" modules in accordance with the principles of the invention. Platform structure 505 is constructed from a row of "A" modules adjacent to a row of "B" modules (further additional alternating rows can be used to extend the platform). Within each row, the "A" or "B" modules are coupled in series, wherein the central vertical rectangular panels of each module in a row are parallel to each other. At the end of a row, a module of the opposite type to be used in the next adjacent row is positioned orthogonally to the last module in the row.

Utilizing similar construction to that illustrated in FIG. 5-A, FIG. 5-C illustrates a first exemplary shelving structure 510 constructed using "A" modules in accordance with the principles of the invention (a similar structure can be constructed from "B" modules). For shelving structure 510, a first group of modules 511 are coupled within a first horizontal plane and a second group of modules 512 are coupled within a second horizontal plane, the second group being supported by the first group (additional groups of modules, such as group 513, can be added as desired). The groups of modules (511, 512, 513) define a vertical structure having a plurality of openings (generally designated by directional arrows into structure) between adjacent ones of the vertical rectangular panels and horizontal panels, wherein the openings define a plurality of shelves in the vertical structure.

Figure 6A:
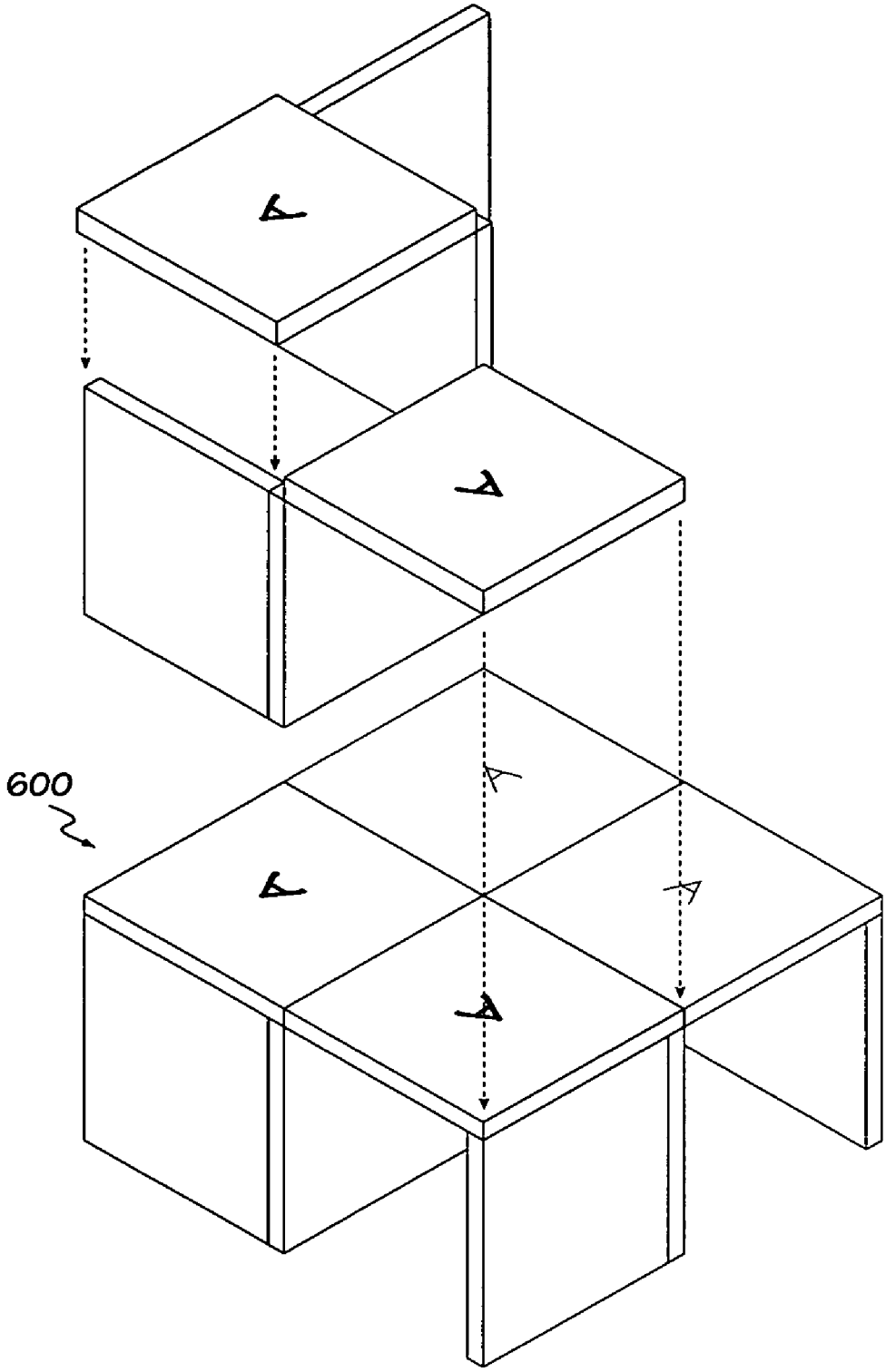
FIG. 6-A illustrates a third exemplary platform structure constructed using modules in accordance with the principles of the invention.
Figure 6B:
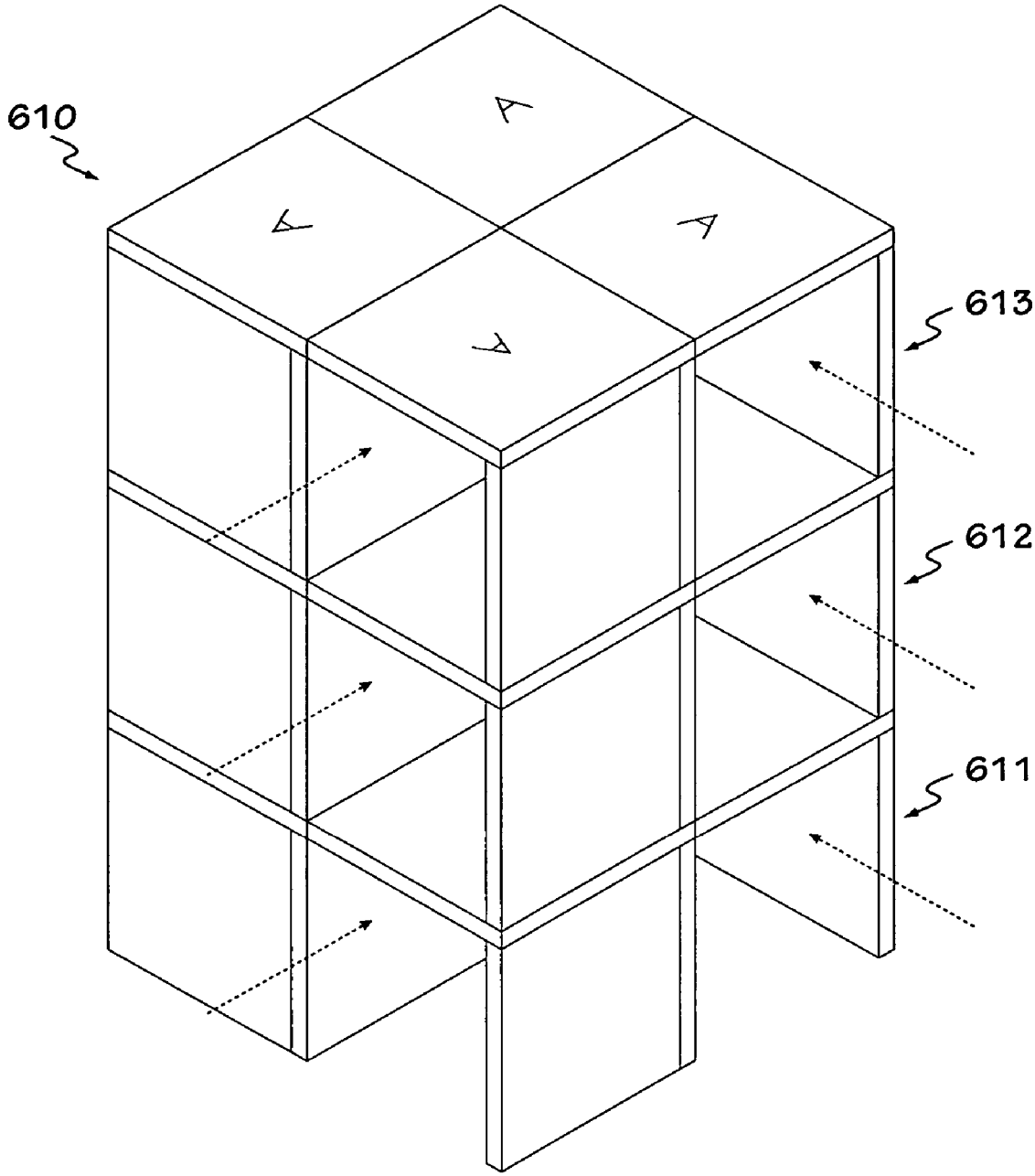

FIG. 6-A illustrates a second exemplary platform structure 600 constructed using "A" modules in accordance with the principles of the invention (a similar structure can be constructed from "B" modules). Platform structure 600 is constructed from four "A" modules coupled orthogonally, wherein the central vertical rectangular panels of adjacent ones of the modules are perpendicular to each other. The horizontal rectangular panel of each module is supported by the top horizontal edges of the central and second vertical panels of an adjacent module. For the platform structure 600, all modules are coupled within a single plane, wherein at least one edge of each horizontal rectangular panel of each module abuts an edge of a horizontal rectangular panel of an adjacent module, whereby the horizontal rectangular panels of all modules define an elevated platform. To extend the size of platform structure 600, additional concentric rows of modules can be placed around the periphery of platform structure 600. Utilizing similar construction, FIG. 6-B illustrates a second exemplary shelving structure 610 constructed using "A" modules in accordance with the principles of the invention (a similar structure can be constructed from "B" modules). For shelving structure 610, a first group of modules 611 are coupled within a first horizontal plane and a second group of modules 612 are coupled within a second horizontal plane, the second group being supported by the first group (additional groups of modules, such as group 613, can be added as desired). The groups of modules (611, 612, 613) define a vertical structure having a plurality of openings (generally designated by directional arrows into structure), wherein the openings define a plurality of shelves in the vertical structure.

Figure 7A:
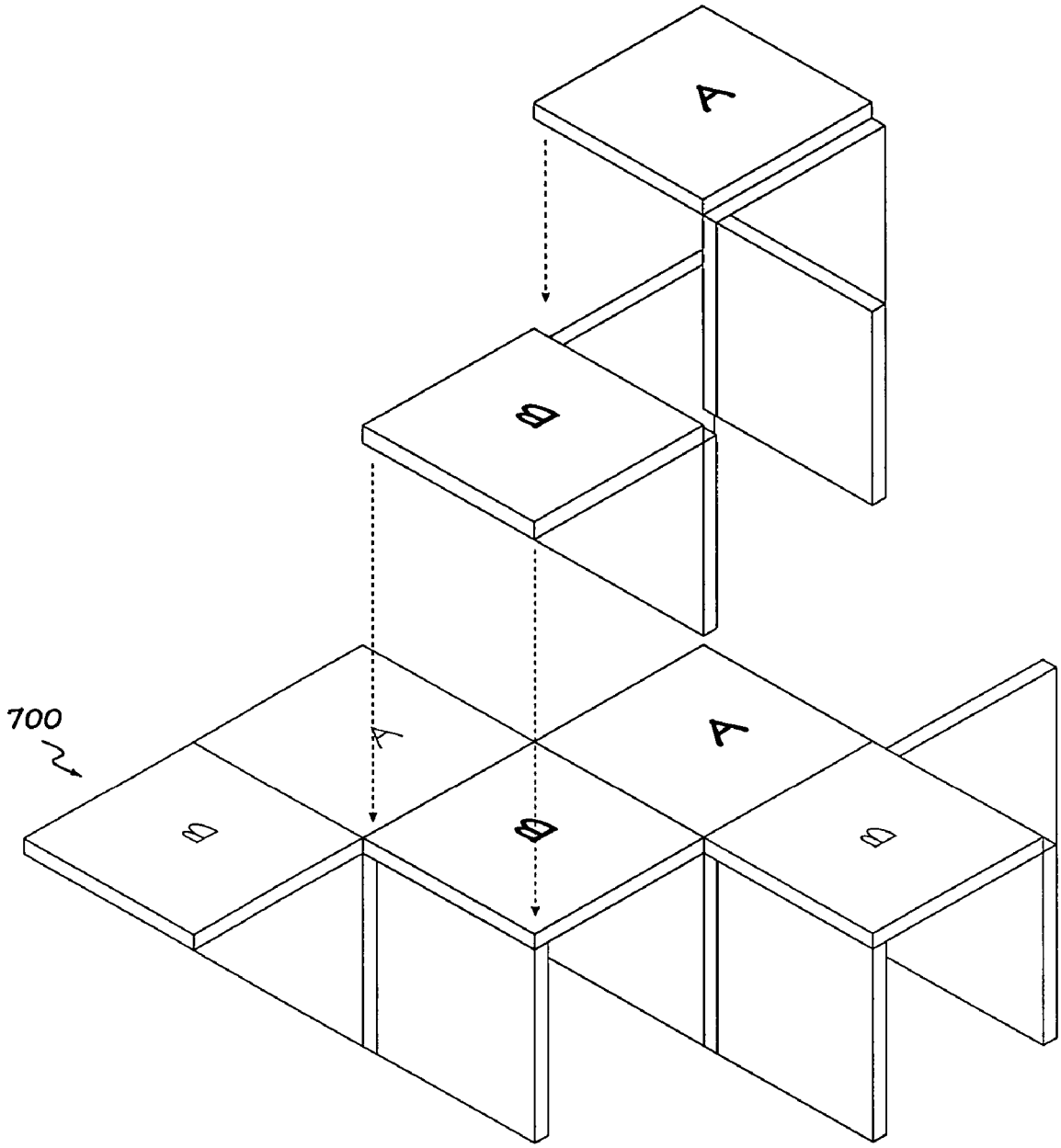
FIG. 7-A illustrates a fourth exemplary platform structure constructed using modules in accordance with the principles of the invention; and, FIG. 7-B illustrates a third exemplary shelving structure constructed using modules in accordance with the principles of the invention.
Figure 7B:
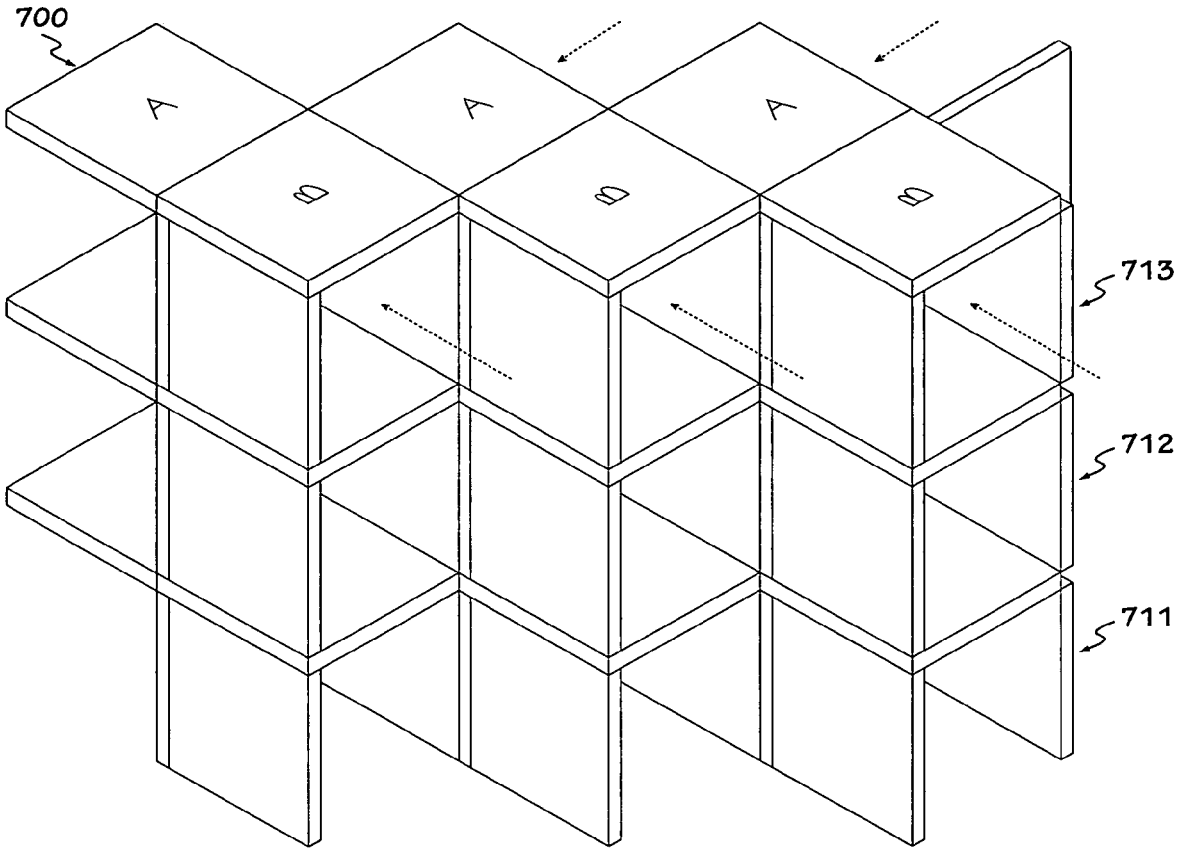

Finally, FIG. 7-A illustrates a third exemplary platform structure 700 constructed using "A" and "B" modules in accordance with the principles of the invention. Platform structure 700 is constructed from an alternating series of "A" and "B" modules coupled orthogonally, wherein the central vertical rectangular panels of adjacent modules are perpendicular to each other. The horizontal rectangular panel of each module is supported by the top horizontal edges of the central and second vertical panels of an adjacent module. For the platform structure 700, all modules are coupled within a single plane, wherein at least one edge of each horizontal rectangular panel of each module abuts an edge of a horizontal rectangular panel of an adjacent module, whereby the horizontal rectangular panels of all modules define an elevated platform. To extend the size of platform structure 700, additional adjacent rows of modules can be placed on either side of platform structure 700. Utilizing similar construction, FIG. 7-B illustrates a third exemplary shelving structure 710 constructed using "A" and "B" modules in accordance with the principles of the invention. For shelving structure 710, a first group of modules 711 are coupled within a first horizontal plane and a second group of modules 712 are coupled within a second horizontal plane, the second group being supported by the first group (additional groups of modules, such as group 713, can be added as desired). The groups of modules (711, 712, 713) define a vertical structure having a plurality of openings (generally designated by directional arrows into structure), wherein the openings define a plurality of shelves in the vertical structure.

Although the present invention has been described in detail, those skilled in the art will conceive of various changes, substitutions and alterations to the exemplary embodiments described herein without departing from the spirit and scope of the invention in its broadest form. The exemplary embodiments presented herein illustrate the principles of the invention and are not intended to be exhaustive or to limit the invention to the form disclosed; it is intended that the scope of the invention be defined by the claims appended hereto, and their equivalents.

What is claimed is:

1. A modular system for constructing platform and shelving structures, said system comprising:

a plurality of modules, each module configurable in either a stowable or assembled configuration, each said module, in said assembled configuration, consisting essentially of:

a central vertical rectangular panel having parallel top and bottom horizontal edges and parallel first and second vertical edges defining opposing first and second vertical sides;

a second vertical rectangular panel having parallel top and bottom horizontal edges and parallel first and second vertical edges;

a first hinge member coupling said second vertical edge of said second vertical rectangular panel proximate to one of said first or second vertical edges of said central vertical rectangular panel, wherein said second vertical rectangular panel extends substantially perpendicular to said first vertical side of said central vertical rectangular panel, and wherein said top horizontal edge of said second vertical rectangular panel is substantially within the same plane as said top horizontal edge of said central vertical rectangular panel;

a horizontal rectangular panel having parallel first and second horizontal edges and parallel third and fourth horizontal edges perpendicular to said first and second horizontal edges; and, a second hinge member coupling said first horizontal edge of said horizontal rectangular panel proximate to said top horizontal edge of said central vertical rectangular panel, wherein said horizontal rectangular panel extends substantially perpendicular to said second vertical side of said central vertical rectangular panel, and wherein a top surface of said horizontal rectangular panel is substantially parallel to the plane containing said top horizontal edges of said central and second vertical panels;

wherein each said module is configurable to said stowable configuration by rotating said second vertical rectangular panel and said horizontal rectangular panel about their hinged edges toward said opposing first and second vertical sides, respectively, of said central vertical rectangular panel until said second vertical rectangular panel and said horizontal rectangular panel are substantially parallel and adjacent to said central vertical rectangular panel, whereby a plurality of said modules in said stowable configuration can be stored in substantially the minimum possible space; and, wherein said plurality of modules comprises at least first and second modules and, when said first and second modules are configured in said assembled configuration, at least a portion of a bottom surface of said horizontal rectangular panel of said first module is supported by said top horizontal edge of said central or said second vertical rectangular panel of said second module.

2. The modular system recited in claim 1, wherein said plurality of modules comprises one or more "A" and one or more "B" modules, wherein:

for each said "A" module, said first hinge member couples said second vertical edge of said second vertical rectangular panel proximate to said first vertical edge of said central vertical rectangular panel; and, for each said "B" module, said first hinge member couples said second vertical edge of said second vertical rectangular panel proximate to said second vertical edge of said central vertical rectangular panel.

3. The modular system recited in claim 1, wherein said hinge members comprise a continuous hinge.

4. The modular system recited in claim 1, wherein an outer face of said second vertical rectangular panel lies in the same plane as the vertical edge of said central vertical panel to which it is hingedly-coupled.

5. The modular system recited in claim 1, wherein a bottom face of said horizontal rectangular panel lies in the same plane as said top horizontal edge of said central vertical panel to which it is hingedly-coupled.

6. The modular system recited in claim 1, wherein said at least a portion of said bottom surface of said horizontal rectangular panel and said top horizontal edge of said central vertical rectangular panel or said second vertical rectangular panel comprise:

a tongue portion; and, a groove portion, wherein said tongue portion associated with one of said horizontal rectangular panel or said central or second vertical rectangular panels of a first module is insertable into said groove portion associated with one of said horizontal rectangular panel or said central or second vertical rectangular panels of a second module.

7. The modular system recited in claim 1, wherein at least a portion proximate said first vertical edge of said second vertical rectangular panel and at least a portion proximate one of said parallel first and second vertical edges of said central vertical rectangular panel comprise:

a tongue portion; and, a groove portion, wherein said tongue portion associated with said second vertical rectangular panel or said central vertical rectangular panel of a first module is insertable into said groove portion associated with said second vertical rectangular panel or said central vertical rectangular panel of a second module.

8. The modular system recited in claim 2, comprising a plurality of "A" or "B" modules coupled in series, wherein said central vertical rectangular panels of each of said plurality of modules are parallel to each other.

9. The modular system recited in claim 2, comprising a plurality of "A" or "B" modules coupled orthogonally, wherein said central vertical rectangular panels of adjacent ones of each of said plurality of modules are perpendicular to each other.

10. The modular system recited in claim 2, comprising at least one "A" module coupled orthogonally to at least one "B" module, wherein said central vertical rectangular panels of adjacent ones of each of said plurality of modules are perpendicular to each other.

11. The modular system recited in claim 2, wherein said plurality of modules are coupled within a single plane, wherein at least one edge of each horizontal rectangular panel of each of said plurality of modules abuts an edge of a horizontal rectangular panel of an adjacent module, whereby said horizontal rectangular panels of said plurality of modules define an elevated platform.

12. The modular system recited in claim 2, wherein a first group of said plurality of modules are coupled within a first horizontal plane and a second group of said plurality of modules are coupled within a second horizontal plane, said second group being supported by said first group, wherein said plurality of modules define a vertical structure having a plurality of openings between adjacent ones of said vertical rectangular panels and said horizontal panels, whereby said openings define a plurality of shelves in said vertical structure.

13. The modular system recited in claim 12, wherein said first and second groups of said plurality of modules comprise "A" or "B" modules coupled in series, wherein said central vertical rectangular panels of each of said plurality of modules are parallel to each other.

14. The modular system recited in claim 12, wherein said first and second groups of said plurality of modules comprise an alternating series of "A" and "B" modules coupled orthogonally, wherein said central vertical rectangular panels of adjacent ones of each of said plurality of modules are perpendicular to each other.

15. A modular system for constructing platform and shelving structures, said system comprising:

at least first and second modules, each module configurable in either a stowable or assembled configuration, each said module, in said assembled configuration, consisting essentially of:

a central vertical member having a top edge and opposing first and second vertical sides;

a second vertical member having a top edge;

a first hinge member coupling said second vertical member to said central vertical member, wherein said second vertical member extends substantially perpendicular to said first vertical side of said central vertical member, and wherein at least a portion of said top edge of said second vertical member is substantially within the same plane as at least a portion of said top edge of said central vertical member;

a horizontal member having a top planar surface; and, a second hinge member coupling said horizontal member proximate to said top edge of said central vertical member, wherein said horizontal member extends substantially perpendicular to said second vertical side of said central vertical member, and wherein a bottom surface of said horizontal member is substantially within the same plane containing said at least a portion of said top edges of said central and second vertical members;

wherein, when said first and second modules are configured in said assembled configuration, at least a portion of said bottom surface of said horizontal member of said first module is supported by said top edge of said central or said second vertical member of said second module;

wherein each said module is configurable to said stowable configuration by rotating said second vertical member and said horizontal member about said first and second hinge members, respectively, toward said opposing first and second vertical sides, respectively, of said central vertical member until said second vertical member and said horizontal member are substantially adjacent to said central vertical member, whereby a plurality of said modules in said stowable configuration can be stored in substantially the minimum possible space.

* * * * *